United States Patent [19]

Yoshida et al.

[11] 4,118,707

[45] Oct. 3, 1978

[54] GYRO STABILIZED PLATFORM FOR SCANNING ANTENNA

[75] Inventors: Takashi Yoshida; Kenzo Kobayashi, both of Yokohama, Japan

[73] Assignee: Tokyo Shibaura Electric Co., Ltd., Kawasaki, Japan

[21] Appl. No.: 792,224

[22] Filed: Apr. 29, 1977

[30] Foreign Application Priority Data

Apr. 30, 1976 [JP] Japan ..... 51-48436

[51] Int. Cl.[2] ..... H01Q 1/18

[52] U.S. Cl. ..... 343/765; 33/321

[58] Field of Search ..... 33/318, 321; 343/765, 343/766, 882

[56] References Cited

U.S. PATENT DOCUMENTS

| | | | |
|---|---|---|---|
| 3,893,123 | 7/1975 | Bieser | 343/765 |
| 4,020,491 | 4/1977 | Bieser et al. | 343/765 |

FOREIGN PATENT DOCUMENTS

| | | | |
|---|---|---|---|
| 864,751 | 4/1961 | United Kingdom | 343/765 |

*Primary Examiner*—Eli Lieberman

*Attorney, Agent, or Firm*—Oblon, Fisher, Spivak, McClelland & Maier

[57] ABSTRACT

An antenna apparatus comprising a gimbals with two axes crossing at right angles mounted on a fixed stand, an antenna base attached to said gimbals to be rocked with the rotation of said gimbals and holding an antenna, flywheels attached to said antenna base for stabilizing said antenna base applying the principle of precession of gyro, a first driving mechanism for rocking said antenna in the elevational direction, a second driving mechanism for rocking said antenna in the azimuthal direction, and a third driving mechanism for shifting the center of gravity on said gimbals in a direction across the direction of rotation of said first driving mechanism.

5 Claims, 5 Drawing Figures

GYRO STABILIZED PLATFORM FOR SCANNING ANTENNA

This invention relates to an improved antenna equipment suitable for use in tracking artificial satellites or other flying objects.

In tracking a flying object or the like flying in any direction in the air by an antenna, there is required a mechanism for pointing such antenna optionally to any azimuthal and elevational directions.

Such antenna is frequently carried by a ship or the like, which itself may be subject to movements such as rolling, pitching, and yawing. Therefore, as for the antenna, it is so devised as to be free from the direct influence of such movements.

Accordingly, a conventional antenna equipment has such construction as illustrated in FIG. 1 or the perspective deal drawing by way of example.

In FIG. 1, a stationary stand 1 to be fixed to the body (not shown) of a ship or the like is provided with a gimbals 2. The gimbals 2 is composed of outer and inner rotary frames (rings) 23 and 24 capable of rocking round two shafts 21 and 22 crossing at right angles. an antenna base 3 is fixedly mounted on the outer rotary frame 24. To such antenna base 3 are attached, through supporting members 31 and 32, shafts 33 and 34 capable of rocking in directions $\alpha$ and $\beta$ at a right angle to each other. Electric motors 35 and 36 are fixed to these shafts 33 and 34, respectively. To the rotary shafts or the motors 33 and 34 are connected flywheels 4 and 5, respectively, so that such flywheels 4 and 5 may always rotate in the directions as indicated by arrows *a* and *b* at a high speed. Therefore, the two flywheels 4 and 5 may, by the so-called gyro effect, will act in such a manner that the antenna base 3 may be always kept level even if the ship pitches and rolls to incline the fixed stand 1.

It is for the sake of countervailing the displacement by the rotation of the earth (on its axis) or the Coriolis effect that the flywheels 4 and 5 are so set as to rotate in the opposite directions *a* and *b*.

On the antenna base 3 is provided a circular sliding rail 37 along which a disc 6 is to be rotated. The disc 6 is rotated by a driving motor 62 through a transmission mechanism 61.

On the disc 6 are fixed a pair of shaft retainers 71 for retaining a rotary shaft 7 which is driven by an electric motor 72 and has an antenna 8 fixed thereon.

The conventional antenna equipment, so constructed as mentioned above, can control the rocking of the antenna 8 to track any target such as flying object by using the driving motor 62 and the motor 72 for control of rotation in the horizontal and elevational directions, respectively.

The conventional antenna equipment with such construction, however, has serious defects in the tracking faculty as its sole object.

That is, in tracking a target moving in the vicinity of the zenith, the angle of rotation in the horizontal direction is extremely wide even if the rotary shaft 72 in the elevational direction is fixed in place. Therefore, in case the target or flying object is moving through only a narrow angle in the vicinity of the zenith, the disc 6 must be rotated at a high speed so that the antenna 8 may track such target. However, the follow-up response to the target is limited by the mechanical construction, so that the conventional antenna equipment is defective in the faculty of following targets.

Further, in tracking targets passing at the same speed and at the same distance from the antenna 8, it is more difficult to follow up one passing through a direction at wider angle of elevation nearer to the zenith than to follow up the other passing through a direction nearer to the horizontal line as viewed from the antenna 8. Thus, in order to eliminate this, there should unavoidably be provided further complicated construction.

Accordingly, an object of this invention is to provide an antenna equipment with a simple construction cleared of the aforementioned defects of the conventional antenna equipment, capable of easily and securely tracking any flying object in any directions.

This invention can be more fully understood from the following detailed description when taken in conjunction with the accompanying drawings, in which.

Figure 2:
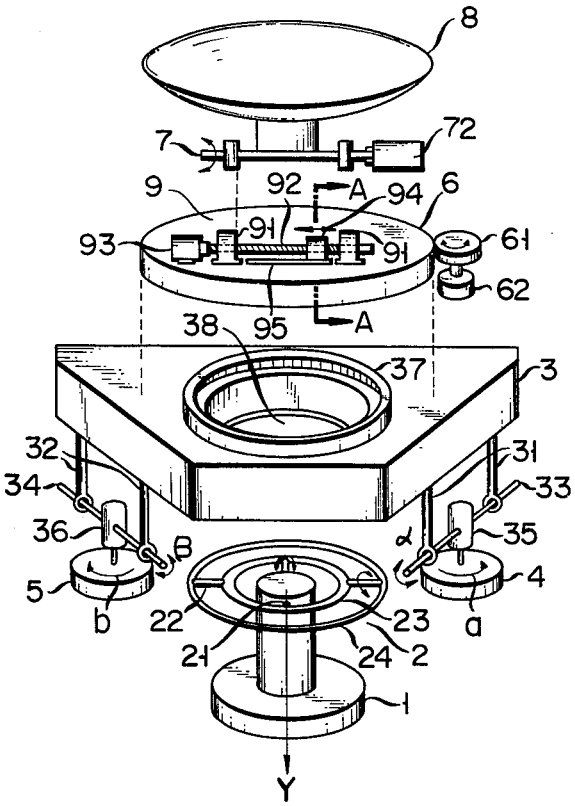
FIG. 2 is a perspective deal view illustrating an embodiment of the antenna equipment according to the invention.

Referring now to FIG. 2, there will be described in detail an embodiment of the antenna equipment according to this invention.

Figure 1:
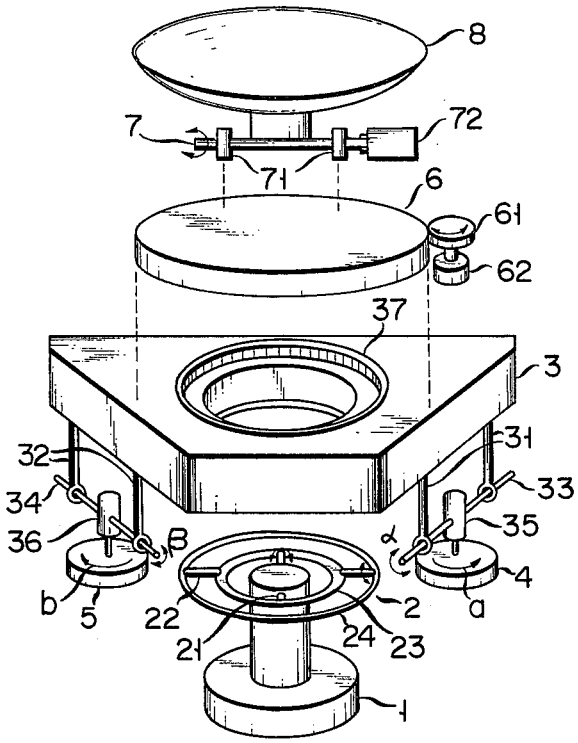
FIG. 1 PRIOR ART
FIG. 1 is a perspective view illustrating the conventional antenna equipment.

In FIG. 2, the components also appearing in FIG. 1 are denoted by the same symbols and will e excluded from the detailed description as follows.

The flat antenna base 3 is fixed to the outer rotary frame 24 of the two rotary frames 23 and 24 forming the gimbals 2, and is so constructed as to incline freely in all directions according to the action of the gimbals 2.

According to this invention, however, the antenna base 3 requires to be so constructed that it may rest in any optional inclined positions (including the level position), so that, similarly to the conventional manner, there are provided the flywheels 4 and 5 to operate in positions at a right angle to each other, thereby stabilizing the position of the base 3.

Thus, in the same way as in FIG. 1, the shafts 33 and 34 capable of rocking in the directions perpendicular to each other are attached to the base 3 through the supporting members 31 and 32, and the flywheels 4 and 5 are rotated at a high speed in the directions as indicated by arrows *a* and *b* by means of the motors 35 and 36 fixed on these shafts 33 and 34.

Namely, as may be known to one skilled in the art, the flywheels 4 and 5 apply the principle of precession of gyro to stabilization of the antenna base 3.

The antenna base 3 has an opening 38 within which the inner rotary frame 23 may be rocked.

Moreover, the antenna base 3 is provided with the circular sliding rail 37 coaxial with the opening 38, along which the disc 6 may be rotated in a horizontal plane. The disc 6, together with the transmission mechanism 61 and the driving motor 62, forms the driving mechanism for rocking the antenna in the azimuthal direction.

On the antenna base 3 in the same manner as in the prior art, there is formed the driving mechanism for rocking the antenna 8 mounted on the rotary shaft 7 in the elevational direction through the motor 72 and the rotary shaft 7.

In the above-mentioned construction, the outer frame 24 of the gimbals 2 is inflicted with the total weight of the antenna base 3 as well as of the disc 6 and the antenna 8, and the center of gravity of these components is always located at a lower point on the central perpendicular line of the gimbals 2 (in Y-direction in FIG. 2).

The antenna equipment of this invention with the aforementioned construction is characterized by including a driving mechanism for shifting the center of gravity on the gimbals 2 from the perpendicular direction.

That is, as shown in FIG. 2, a centroid shifting mechanism 9 is provided on the disc 6 e.g. in parrallel with the rotary shaft 7. The centroid shifting mechanism 9 includes, by way of example, a pair of screw bar supports 91 fixed on the disc 6 at a predetermined interval and a screw bar 92 rotatably supported by the supports 91 and rotated by an electric motor 93 fixed on the disc 6 so that a weight 94 connected to the screw bar 92 may slide from side to side accompanying the rotation of the screw bar 92.

Figure 3:
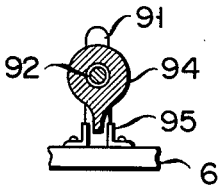
FIG. 3 is an enlarged partial sectional view of the centroid shifting mechanism, along a line A—A of FIG. 2.

Referring now to FIG. 3 showing on an enlarged scale a portion of the centroid shifting mechanism 9 as taken from line A—A in FIG. 2 in the direction as indicated by the arrows, the weight 94 is provided with a female thread engaging with the thread on the screw bar 92, and a slide rail 95 to prevent the rotation of the weight 94 is mounted on the disc 6 so that the weight 94 may move from side to side accompanying the rotation of the screw bar 92 along the rail 95.

Since the equipment of this invention is provided with such centroid shifting mechanism, the antenna 8 will be able to track a target very easily and securely even if such target is flying in the vicinity of the zenith.

The centroid shifting mechanism 9 is to shift the weight 94 in the axial direction corresponding to the elevational direction in which the antenna 8 itself is rocked, thereby biasing the center of gravity of the gimbals 2 from the central perpendicular direction thereof to the moving direction of the weight 94 and including directly the antenna 8 to e.g. the direction perpendicular to the elevational direction. Addition of such centroid shifting mechanism enables the equipment to perform directly and immediately an action equivalent to rotation of the disc 6 through an angle of 90° in the horizontal direction in picking up and following the target in the vicinity of the zenith and to track such target far faster with simpler construction as compared with tracking by using the rotation of the disc 6. Now I will further describe the principle of operation of the centroid shifting mechanism with reference to FIG. 4.

Figure 4:
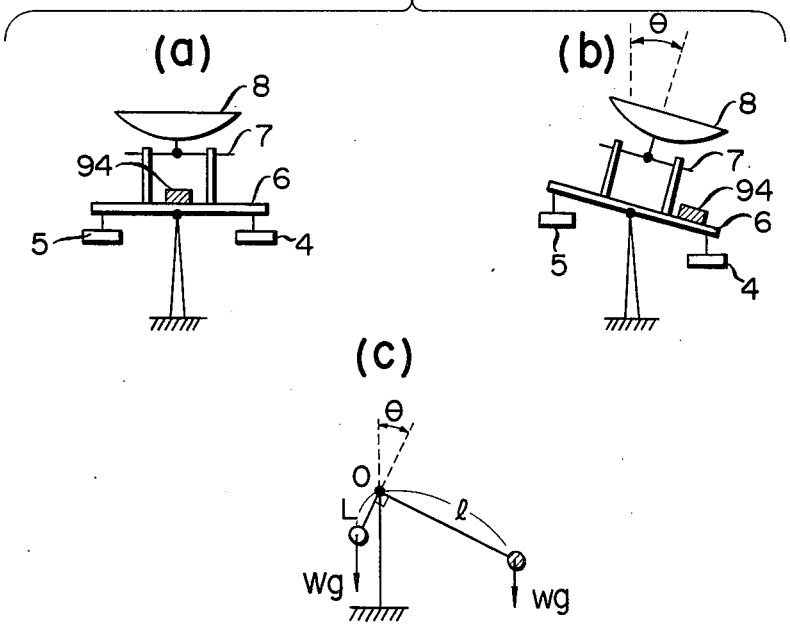
FIG. 4 is a schematic view illustrating the principle of operation of the antenna equipment according to the invention.

Here, in FIG. 4, the equipment of FIG. 2 is illustrated schematically to meet the convenience of explanation.

FIG. 4*a* shows a state in which the weight 94 is located on the central perpendicular line of the gimbals and the disc 6 is horizontally balanced.

FIG. 4*b* shows a state in which the pointing direction of the antenna 8 is inclined at an angle of $\theta$ to the perpendicular direction for balance as a result of the shift of the weight 94 to the right. Referring now to FIG. 4*c* for description of such state of balance, the weight of the weight 94 is given at *wg*, while the force of gravity on the gimbals excluding the weight of the weight 94 is given at W*g*. The force of gravity W*g* is inflicted on a point at a downward distance L from the fulcrum of the gimblas. If the weight *wg* of the weight 94 is inflicted on a point at a distance *l* from such fulcrum, the antenna will be balanced after inclining through the angle of $\theta$ fulfilling the following equation.

$$WgL \sin\theta = wgl \cos\theta$$

$$\theta = \tan^{-1} w\, l/W\, L$$

Accordingly, since W*g* and L are constant, the tilt angle $\theta$ of the antenna may be adjusted according to the weight *wg* of the weight 94 and the deviation *l* from the central position.

Thus, in FIG. 2, an optional tilt angle $\theta$ may be obtained by controlling the number of revolutions and the angle of rotation of the motor 93. If the direction of rotation by the rotary shaft 7 in the elevational direction is given as the X-direction, inclination at such angle $\theta$ gives the antenna a rotation in the Y-direction perpendicular to such X-direction, providing function of the so-called azimuth-elevation (AZ-EL) mount plus X-Y mount.

Figure 5:
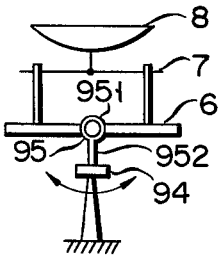
FIG. 5 is a schematic view illustrating another embodiment of the equipment of the invention.

In order to shift the center of gravity to the direction of the rotary shaft of the driving mechanism for rocking in the elevational direction, the antenna equipment of this invention may be further provided with a so-called rotary solenoid 95 to rotate on the disc 6 as shown in FIG. 5 as another embodiment of the invention, having a shaft 951 of the rotary solenoid 95 fixed to the weight 94 through a support arm 952.

Thus, the equipment of this invention comprising the gimbals 2 and flywheels 4 and 5 for stabilizing the position of the antenna characterized by including the first driving mechanism, for example constructed by the rotary shaft 7 and the electric motor, rocking the antenna in the elevational direction, the second driving mechanism, for example constructed by the disc 6 and the driving motor 62 for rocking the antenna in the azimuthal direction, and the third driving mechanism for shifting the center of gravity inflicted on the gimbals in the direction of the rotary shaft of the first driving mechanism or the direction e.g. at a right angle to the rocking direction of the antenna in the elevational direction by the first driving mechanism; capable of quickly and securely following targets in the vicinity of the zenith by scanning the elevational direction two-dimensionally by means of the additional centroid shifting mechanism with simple construction.

As has been described above, the antenna equipment of this invention is to constructed that the antenna may be operated (especially) to track at a high speed targets flying in the vicinity of the zenith where the angle of elevation is very large by only adding the centroid shifting mechanism to the conventional antenna equipment across the driving direction in the elevational direction, thereby displaying a great performance in tracking flying targets such as artificial satellites.

What is claimed is:

1. An antenna apparatus comprising a stationary stand, a gimbals having an inner rotary frame connected to the stationary stand to be rotated about a first horizontal axis and an outer rotary frame connected to the inner rotary frame to be rotated about a second horizontal axis normal to the first horizontal axis, an antenna supporting means attached to the gimbals to rock with the rotation thereof, an antenna mounted on the antenna supporting means, a plurality of flywheels attached to the antenna supporting means for stabilizing the antenna supporting means applying the principle of precession of gyro, a first driving mechanism for rocking the antenna in the elevational direction, a second driving mechanism for rocking the antenna in the azimuthal direction, and a third driving mechanism for shifting the center of gravity on the gimbals in a direction across the direction of the rotation of the first driving mechanism.

2. An antenna apparatus according to claim 1 wherein said antenna supporting means includes an antenna base amounted on the gimbals and a rotary disc mounted on the antenna base, the antenna mounted on the rotary disc.

3. An antenna apparatus according to claim 2 wherein said third driving mechanism includes a weight shiftably mounted on the rotary disc and a shifting mechanism mounted on the rotary disc to shift the weight.

4. An antenna apparatus according to claim 3 wherein said shifting mechanism includes a pair of screw bar supports fixed on the rotary disc at a predetermined interval, a screw bar rotatably supported by the screw bar supports and holding the weight in a screw relationship therewith, a motor for rotating the screw bar and a guide member for preventing the rotation of the weight to slide the weight along the screw bar during the rotation of the screw bar.

5. An antenna apparatus according to claim 2 wherein said third driving mechanism includes a weight, a rotary solenoid and a connecting member for connecting the weight to the rotary solenoid to rotate the weight in the direction across the direction of rotation of said first driving mechanism.

* * * * *